US010040592B2

(12) United States Patent
Hyca

(10) Patent No.: US 10,040,592 B2
(45) Date of Patent: Aug. 7, 2018

(54) APPARATUS FOR CHANGING PAPER ROLLERS OF A LABELLING MACHINE AND CORRESPONDING METHOD FOR CHANGING PAPER ROLLS

(71) Applicant: ESPERA-WERKE GmbH, Duisburg (DE)

(72) Inventor: Bohumil Hyca, Stuttgart (DE)

(73) Assignee: Espera-Werke GmbH, Duisburg (DE)

( * ) Notice: Subject to any disclaimer, the term of this patent is extended or adjusted under 35 U.S.C. 154(b) by 281 days.

(21) Appl. No.: 14/910,541

(22) PCT Filed: Oct. 17, 2014

(86) PCT No.: PCT/EP2014/072312
§ 371 (c)(1),
(2) Date: Feb. 5, 2016

(87) PCT Pub. No.: WO2015/059048
PCT Pub. Date: Apr. 30, 2015

(65) Prior Publication Data

US 2016/0185477 A1 Jun. 30, 2016

(30) Foreign Application Priority Data

Oct. 24, 2013 (DE) ..... 10 2013 017 574

(51) Int. Cl.
*B65C 9/18* (2006.01)
*B65H 19/12* (2006.01)

(52) U.S. Cl.
CPC ..... *B65C 9/1892* (2013.01); *B65H 19/123* (2013.01); *B65H 2701/11332* (2013.01); *B65H 2701/192* (2013.01); *B65H 2701/1936* (2013.01)

(58) Field of Classification Search
CPC ..... B65H 19/123; B65H 2701/192; B65H 2701/1936; B65H 2701/11332; B65C 9/1892
See application file for complete search history.

(56) References Cited

U.S. PATENT DOCUMENTS 4,290,734 A * 9/1981 Van Breen ..... B65G 1/127 198/801
4,483,493 A 11/1984 Schonmeier
(Continued)

FOREIGN PATENT DOCUMENTS

CN 102498041 A 6/2012
JP 2013032206 A 2/2013

*Primary Examiner* — William Arauz Rivera
(74) *Attorney, Agent, or Firm* — Rankin, Hill & Clark LLP

(57) ABSTRACT

An apparatus for changing paper rolls in a labelling machine that includes a first paper roll receptacle that includes a first roll carrier connected to a first end of a shaft, which can be moved along an axis between an unwinding position and a transfer position. The first roll carrier has at least one clamping device that is radially displaceable between a clamping position and a release position. The apparatus further includes a second paper roll receptacle that includes a second roll carrier that in a storage position is disposed coaxially with respect to the first roll carrier. In the transfer position, the first roll carrier together with the clamping device is disposed at least in sections in an interior of the second roll carrier. In the unwinding position, the first roll carrier together with the clamping device is disposed at least in sections outside the second roll carrier.

19 Claims, 4 Drawing Sheets

(56) References Cited

U.S. PATENT DOCUMENTS

Figure 1:
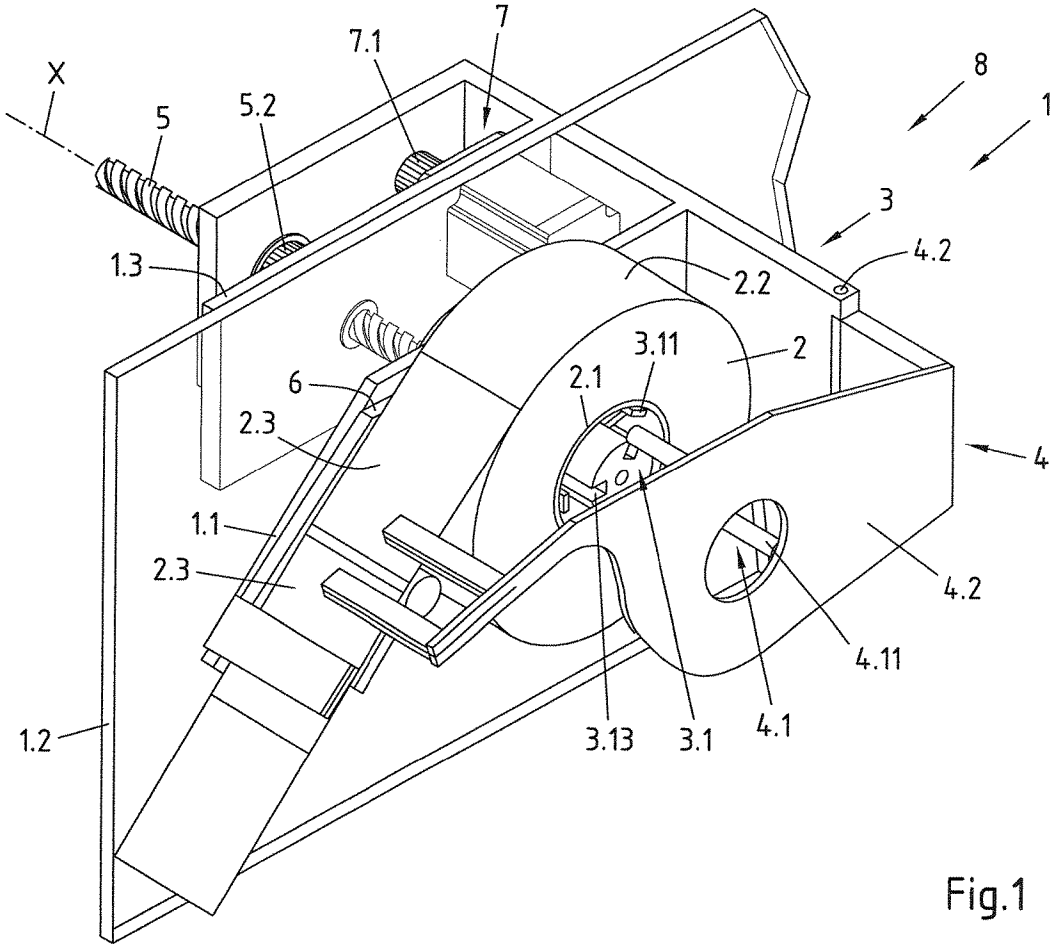

| | | | | | |
|---|---|---|---|---|---|
| 4,687,244 | A | * | 8/1987 | Cullen | B65H 67/065 294/86.41 |
| 4,840,321 | A | | 6/1989 | Focke | |
| 4,856,960 | A | | 8/1989 | Wheeler | |
| 4,953,805 | A | * | 9/1990 | Rauh | B65H 19/123 242/559.1 |
| 5,031,381 | A | | 7/1991 | Focke | |
| 5,249,757 | A | | 10/1993 | Draghetti | |
| 5,299,751 | A | * | 4/1994 | Pichlmair | B65H 16/06 242/534 |
| 5,330,126 | A | | 7/1994 | Grischenko | |
| 5,332,351 | A | * | 7/1994 | Nelson | B21C 47/24 414/684 |
| 5,366,174 | A | | 11/1994 | Tsukamoto | |
| 6,056,232 | A | * | 5/2000 | Karaki | G03B 17/26 242/559.3 |
| 6,093,005 | A | * | 7/2000 | Nakamura | F01C 1/023 418/101 |
| 7,056,076 | B2 | * | 6/2006 | Ichikawa | B65H 19/123 242/563 |
| 7,674,086 | B2 | * | 3/2010 | Schmidt-Hebbel | B65H 19/12 242/533.7 |
| 2002/0067979 | A1 | | 6/2002 | Ichikawa | |
| 2012/0216956 | A1 | | 8/2012 | Korthauer | |

* cited by examiner

APPARATUS FOR CHANGING PAPER ROLLERS OF A LABELLING MACHINE AND CORRESPONDING METHOD FOR CHANGING PAPER ROLLS

The present invention relates to an apparatus for changing paper rollers in a labelling machine having a first paper roller receptacle for a first paper roll, wherein the first paper roll receptacle comprises a first roll carrier. The present invention also relates to a corresponding labelling machine with a labelling device which has a feed device for supplying a carrier strip of a first paper roll, where the carrier strip is provided with detachable labels as well as a transfer device for transferring labels from the carrier strip onto an object to be labelled. The invention further relates to a method for changing paper rolls, in particular using an apparatus as defined previously in which the following steps are carried out: fitting a first roll carrier of a first paper roll receptacle with a first paper roll in an unwinding position whereby the first paper roll is placed in the first roll carrier, and unwinding the first paper roll in the unwinding position of the first roll carrier.

A paper roll means a wound-on material strip of labels (linerless labels) or a carrier strip, for example carrier paper strip with adhesive labels. Such paper rolls are used in so-called labelling machines with which adhesive labels which can be printed with information are adhered to objects (goods or products) to be labelled. A labelling machine is known, for example, from DE 10 2007 034 698 A1. This labelling machine comprise a labelling apparatus which includes a feed device for feeding a carrier strip which is provided with detachable labels (so-called adhesive labels). Such a carrier strip is usually supplied from a paper roll. The labelling machine is furthermore provide with a transfer device for transferring the labels from the carrier strip onto the respective object to be labelled.

In labelling machines of the type described previously which therefore use paper rolls for feeding the material or carrier strip, it is important to feed the material or carrier strip as continuously as possible so that the labelling process is as far as possible not interrupted or at least not for a large time interval. Care must therefore be taken to ensure that when a paper roll is completely unwound or contains no more labels, the paper roll change (that is the insertion of a new paper roll) does not cause any appreciable time delay.

An aid with which the time required for a paper roll change can be bridged is for example a buffer with so-called dancer rolls. In such a buffer a section, e.g. of a carrier strip unwound from the respective paper roll is deflected many times over deflecting rollers of which at least some are movable and thereby "intermediately stored". When the paper roll is now unwound, the end of the unwound carrier strip is joined to the beginning of a new paper roll and the paper roll is inserted in the feed device. In the time required to join the end of the unwound carrier strip to the beginning of the carrier strip wound on the new paper roll and insert the new paper roll in the feed device, the distance between the deflecting rollers in the buffer is reduced further and further by moving some or all of the deflecting rollers with the result that the carrier strip can still be supplied continuously or in a clocked manner from the buffer to the downstream transfer device although the end of the carrier strip stands still during the said time interval (or at least moves less rapidly).

It is the object of the present invention to optimize the paper roll change in a labelling machine.

The previously derived and indicated object is achieved according to a first teaching of the present invention by an apparatus for changing paper rolls, in particular rolls of a wound material strip of labels or carrier strips, for example, carrier paper strips with adhesive labels in a labelling machine

- comprising a first paper roll receptacle for a first paper roll, which is used in particular for the arrangement of a paper roll, in particular for clamping a paper roll which is to be unwound (the unwinding takes place in particular in the course of a labelling process in which products or goods are labelled),
- comprising a second paper roll receptacle for a second paper roll which therefore serves in particular for the arrangement of a paper roll which, when the first paper roll has been unwound or has been removed for other reasons is to be transferred to the location of the first paper roll,
- comprising a shaft which can be moved to and fro, that is in the axial direction, along an axis (in principle the shaft can have any arbitrary cross-section but preferably has a round cross-section and is particularly preferably configured as a spindle),
- wherein the first paper roll receptacle comprises a first roll carrier connected to a first end of the shaft, wherein the first roll carrier is used for or configured in particular for insertion into the interior of a paper roll or of a paper roll core element and for carrying the paper roll,
- wherein the first roll carrier, in particular together with the shaft, can be moved to and fro along the axis between an unwinding position and a transfer position,
- wherein the first roll carrier has at least one clamping device, for example clamping jaw, which is radially (relative to the axial direction) displaceable, preferably radially pivotable, between a clamping position and a release position, having a contact surface (for contact with the interior of a paper roll or a paper roll core element) which in the clamping position lies radially further outwards than in the release position,
- wherein the second paper roll receptacle has a second roll carrier which in a storage position is disposed coaxially with respect to the first roll carrier, wherein the second roll carrier is used for or configured in particular for insertion into the interior of a paper roll or of a paper roll core element and for carrying the paper roll,
- wherein in the transfer position of the first roll carrier the first roll carrier together with the at least one clamping device, in particular clamping jaw, is disposed at least in sections in the interior of the second roll carrier disposed in the storage position, that is at least in sections in the interior of the intervention region of the second roll carrier disposed in the storage position and
- wherein in the unwinding position of the first roll carrier the first roll carrier together with the at least one clamping device, in particular clamping jaw, is disposed at least in sections outside (that is axially adjacent to) the second roll carrier disposed in the storage position, that is at least in sections outside the intervention region of the second roll carrier disposed in the storage position.

Not only a clamping jaw can be used as clamping device but also, for example, an eccentric or air cushion. It is essential that the clamping device can expand and contract radially.

When there is talk of the interior of the second roll carrier, the intervention region of the second roll carrier is meant; accordingly, if there is talk of the region outside the second roll carrier, the region outside the intervention region of the second roll carrier is meant. The intervention region of the second roll carrier means the free space in the interior of a paper roll held by the second roll carrier as intended, that is the space in which the second roll carrier intervenes. In other words, the intervention region is defined as a space with the shape of a right circular cylinder whose cylinder axis runs coaxially to the axis of the shaft to which the first roll carrier is connected and whose lateral surface contacts the point(s) of the second roll carrier furthest from the cylinder axis.

The apparatus according to the invention, which can be part of a feed device for feeding a carrier strip with adhesive labels, where the feed device can be part of a labelling apparatus of a labelling machine, allows paper rolls to be changed simply and in particular automatically, that is the exchange of a new paper roll for an old or unwound paper roll. In this case, the second paper roll receptacle can be equipped with a second (new) paper roll without pressure of time whilst the first (old) paper roll is unwound in the first paper roll receptacle. The insertion of a paper roll into the second paper roll receptacle has no perturbing influence on the unwinding of the first paper roll in the first paper roll receptacle. Since the first roll carrier can be moved to and fro by the shaft, which as stated is in particular a spindle, between the unwinding position or first paper roll receptacle on the one hand and the transfer position or second paper roll receptacle on the other hand, the second paper roll can be moved (transferred) by simple means from the second paper roll receptacle into the first paper roll receptacle, as soon as the old paper roll or the paper roll core element on which the old paper roll was wound is removed from the first paper roll receptacle. Since the shaft and therefore the first roll carrier is moved along an axis, the transport path of the new paper roll from the second paper roll receptacle to the first paper roll receptacle can be shortened to a minimum, so that the paper roll can be changed in a very short time.

In order to assist the transport of the second paper roll from the second paper roll receptacle into the first paper roll receptacle, and in particular to partially or completely automate this, according to the invention as stated, furthermore at least one clamping device, in particular clamping jaw, is provided as part of the first roll carrier, which can be moved to and fro relative to the remaining part of the first roll carrier between a clamping position and a release position. This to and fro movement is accomplished, as will be explained subsequently as an example, by cooperation of the first end of the shaft or spindle with the first roll carrier and the clamping devices, e.g. clamping jaws. In principle, the at least one clamping device, in particular clamping jaw when the first roll carrier is in the transfer position, can be brought into the clamping position in which the contact surface of the clamping device, in particular clamping jaw, axially fixes the paper roll (preferably presses the contact surface of the clamping device inside against the paper roll or the paper roll core element). In this clamped or axially fixed state, the paper roll can now be moved from the second paper roll receptacle to the first paper roll receptacle whereby the first roll carrier is moved back from the transfer position into the unwinding position. The unwinding process can then take place. After the end of the unwinding process, in order to remove the old paper roll or the paper roll core element of the old paper roll from the first paper roll receptacle, preferably the first roll carrier can be brought into an ejection position which is even farther away from the transfer position than the unwinding position. As a result of the movement of the first roll carrier into the ejection position, the at least one clamping device, in particular clamping jaw, is brought into the release position again, that is the contact surface is released from the interior of the paper roll or the paper roll core element. At the same time, the paper roll or the paper roll core element can be scraped from the first roll carrier so that the first roll carrier is then no longer equipped and can be used to receive the new, that is the second, paper roll.

As already indicated previously, the shaft which is connected to the first roll carrier is preferably configured as a spindle. A spindle in the sense of the present invention comprises a shaft with an external thread. In particular, the first roll carrier has an internal thread corresponding to the external thread of the spindle. As a result, the first roll carrier can be moved relative to the spindle (by a screw movement). However, it is also possible that the movements of the spindle, that is the rotational and translational movement is transferred to the first roll carrier. The spindle can therefore in principle fulfil two functions, namely on the one hand execute a movement relative to the first roll carrier (and thereby for example displace the at least one clamping device, in particular clamping jaw, between the clamping position and the release position) and on the other hand move the first roll carrier itself (and thereby for example transport a paper roll from the second paper roll receptacle to the first paper roll receptacle and/or eject or remove a paper roll from the first paper roll receptacle).

It should be pointed out that in the simplest case in principle a single clamping device, in particular clamping jaw, is sufficient for the described operating mode, in this case, therefore the first roll carrier has precisely one clamping device, in particular clamping jaw. Preferably however the first roll carrier has at least two, particularly preferably at least three, clamping devices or clamping jaws, which are radially displaceable, preferably radially pivotable, between a clamping position and a release position, with a contact surface which in the clamping position lies radially further outwards than in the release position. Each of these clamping device or clamping jaws is then configured as the previously described at least one clamping device or clamping jaw and cooperates with the remaining components in the same way. When therefore there is talk hereinafter of the at least one clamping device, in particular clamping jaw, this therefore means bot the case where only a single clamping device, in particular clamping jaw, is provided and also the case that a plurality of clamping devices or clamping jaws are provided, which in particular are configured and function in the same way.

The one clamping device or jaw or the plurality of clamping devices or jaws can be configured in lever form where the respective clamping jaw or the lever forming the clamping device or clamping jaw is articulated to or moulded on the first roll carrier, where one end of the respective clamping device or the lever cooperates with the first end of the shaft or spindle and the respectively other end of the respective clamping device or the lever has the contact surface.

According to one embodiment of the apparatus according to the invention as stated, the first roll carrier is movable along the axis, that is in the axial direction, into an ejection position which is farther away from the transfer position (in the axial direction) than the unwinding position. In other words, in this case the unwinding position lies axially between the ejection position and the transfer position. All the positions lie on the same axis, are therefore arranged coaxially with one another. Since the first roll carrier can be brought into an ejection position, as stated an old paper roll can be removed or ejected from the first roll carrier in order to then be able to equip the first roll carrier with a new paper roll.

According to a further embodiment, the apparatus has a scraper element which passes the first roll carrier when it is moved along the axis from the unwinding position into the ejection position. The scraper element is used to scrape the old paper roll or the paper roll core element from the first roll carrier when the first roll carrier is moved from the unwinding position into the ejection position. The scraper element can comprise the edge of an opening in a wall of the apparatus (that is the material of the wall which delimits/surrounds the opening), where the opening in particular has a diameter which corresponds to the outside diameter of the first roll carrier in the state when the at least one clamping device or clamping jaw is in the release position (smallest possible circumference of the first roll carrier). The scraper element can also be used at the same time to move the at least one clamping device or clamping jaw from the clamping position into the release position; thus, in the state in which the at least one clamping device or clamping jaw is in the clamping position (greatest possible circumference of the first roll carrier), the first roll carrier has a larger circumference than in the state in which the at least one clamping device or clamping jaw is in the release position. When the first roll carrier on the path from the unwinding position into the ejection position, passes the scraper element or is guided through the opening in the wall of the device, the at least one clamping device or clamping jaw necessarily impacts against the scraper element or the edge of the said opening and if the first roll carrier is moved further in the direction of the ejection position, is pushed in the direction of the release position.

Hereinafter it is now explained as an example how the paper roll change can be achieved technically. Thus, according to one embodiment of the apparatus according to the invention it is provided that the at least one clamping device or clamping jaw is configured or is movable or driven such that and/or cooperates with the shaft and the remaining roll carrier so that when the first roll carrier is in the transfer position, it is the clamping position or can be brought into the clamping position, which is preferably accomplished automatically (automated).

According to a further embodiment of the apparatus according to the invention, it is further provided that the at least one clamping device or clamping jaw is configured or is movable or driven such that, and/or cooperates with the shaft and the remaining roll carrier so that, when the first roll carrier is in the unwinding position, it is in the clamping position or in an intermediate position between the clamping position (a) and the release position or can be brought into an intermediate position between the clamping position and the release position, which is preferably accomplished automatically (automated).

Furthermore, according to yet another embodiment of the apparatus according to the invention, it is provided that the at least one clamping device or clamping jaw is configured or is movable or driven such that and/or cooperates with the shaft and the remaining roll carrier so that when the first roll carrier is in the ejection position, it is in the release position or can be brought into the release position which is preferably accomplished automatically (automated).

In particular, the first roll carrier is connected to the shaft so that as a result of a rotational movement of the shaft about the axis and/or translational movement of the shaft along the axis, the radial displacement of the at least one clamping device or clamping jaw between the clamping position and the release position is brought about.

The shaft (as stated this means in particular a spindle) can be moved along the said axis, i.e. axially relative to the first roll carrier which can be achieved whereby the first roll carrier is fixed axially and/or radially, for example, abuts against a stop or whereby the shaft is moved abruptly, that is suddenly so that due to the inertia of the first roll carrier, this cannot follow the movement of the shaft or the movement of the shaft is not transferred completely to the first roll carrier. If on the other hand, the shaft is only slowly accelerated or moved, as a result of the friction between roll carrier and shaft, the movement of the shaft is completely or at least almost completely transferred to the first roll carrier so that this moves rotationally or translationally with the shaft.

As a result of the preceding configuration of the apparatus according to the invention and in particular due to the described interaction between shaft, clamping device(s) and remaining roll carrier, upon reaching the individual position of the first roll carrier (transfer position, unwinding position, ejection position), the following is achieved:

Transfer position: the shaft is moved to the transfer position, in particular by a first motor of a drive. The end facing the first roll carrier or connected to the first roll carrier, that is the first end of the shaft presses the clamping device(s) apart or into the clamping position as soon as the first roll carrier is in the transfer position. For example, this is achieved whereby the first roll carrier enters or is pressed into the transfer position at an axial stop which prevents the first roll carrier from being able to move further away from the unwinding position than to this point, where the shaft can nevertheless still move further in the direction from the unwinding position to the transfer position, can therefore the move relative to the first roll carrier (in particular into this) and thereby brings the clamping device(s) articulated to or moulded on the first roll carrier into the clamping position. The second paper roll disposed on the second roll carrier is in this way clamped on the first roll carrier.

Unwinding position: if the shaft is then moved from the transfer position back into the unwinding position, for example, by the first motor, the position of the shaft relative to the first roll carrier and relative to the clamping device(s) does not change or at least barely changes. In this case during the movement from the transfer position into the unwinding position, the shaft does not turn or at least does not turn significantly. The paper roll still remains clamped on the first roll carrier. It can occur that during the movement from the transfer position into the unwinding position, the force transferred from the shaft onto the at least one clamping device or clamping jaw which presses the at least one clamping device or clamping jaw into the clamping position, diminishes somewhat with the result that the at least one clamping device or clamping jaw would then no longer be exactly in the clamping position (that is the maximum outer position with the highest clamping force) but deviates somewhat from this position (this position was previously defined as intermediate position between the clamping position and the release position). Despite a small deviation from the clamping position, in this intermediate position however the clamping force which transfers the at least one clamping device or clamping jaw over its contact surface onto the interior of the paper roll, is then still sufficient to fix the paper roll on the first roll carrier for the purpose of unwinding in the unwinding position. Fundamentally it is also feasible that the clamping position is retained in any case during transport of the roll from the transfer position to the unwinding position, for example, whereby upon reaching the clamping position, the at least one clamping device or clamping jaw is blocked by a securing means. The blocking or the securing means can then be released manually or automatically if required.

Ejection position: finally if the shaft is moved further away from the transfer position in the axial direction, in particular by the first motor, namely into the ejection position, the shaft again moves relative to the first roll carrier and specifically this time in the opposite direction to that in the transfer position (in particular the shaft moves partially out from the first roll carrier), with the result that the pressure or the force of the shaft on the clamping device(s) diminishes or is cancelled and the clamping device(s) can move back into the release position. The latter can also be accomplished by actuation of the first motor. In the event that a securing means has blocked the clamping device(s) in the clamping position, this securing means is released in the ejection position or the blocking is cancelled. The movement of the clamping device(s) from the clamping position into the release position can be assisted by a pre-tension which is exerted by a spring or spring force on the clamping device (s). Additionally or alternatively the scraper element can be configured so that as soon as the first roll carrier passes this in the direction of the ejection position, it compresses the clamping device(s) or presses them into the release position. The relative movements between shaft and first roll carrier can be accomplished in different ways, for example, by a jerky or sudden movement of the shaft which has the result that as a result of its inertia the first roll carrier does not move or barely moves. Additionally or alternatively, the first roll carrier in the ejection position can however also be pressed against an axial stop which prevents the first roll carrier from moving in the axial direction further from the unwinding position where the shaft however can nevertheless still move further in the direction from the unwinding position to the ejection position, that is can again move relative to the first roll carrier, in particular out from this and as a result, the clamping device(s) articulated to or moulded on the first roll carrier is moved into the release position. The old paper roll disposed on the first roll carrier in the unwinding position is then scraped or ejected since it is no longer clamped.

According to yet another embodiment, the apparatus comprises a drive, which comprises at least one motor, preferably two motors and which moves the shaft translationally (i.e. to and fro) along the axis, that is in the axial direction and moves the shaft rotationally (i.e. rotatingly) about the axis. When using two motors, the one motor, in particular when the other motor is at a standstill, can bring about the translational movement of the shaft. In particular, a radial displacement of the clamping device(s), especially the clamping jaw(s), can be brought about in this case whereby only the motor for the translational movement is actuated whilst the other is at a standstill. If the first roll carrier is to be set in rotation in order for example to actively turn the roll carrier located therein, both motors can be actuated. Such a drive can comprise an electric drive (with one or two electric motor(s)).

According to yet another embodiment of the apparatus according to the invention, it is provided that the second paper roll receptacle and/or the second roll carrier is movable between the storage position and an equipping position, in particular is pivotable wherein in the equipping position the second roll carrier lies outside the movement range of the first roll carrier. The storage position is the position of the second roll carrier in which the second paper roll is mounted before transfer to the first roll carrier. The storage position of the paper roll receptacle or the second roll carrier therefore overlaps in particular with the transfer position of the first roll carrier since in the transfer position the transfer takes place from the second paper roll receptacle to the first roll carrier. The equipping position of the second paper roll receptacle or the second roll carrier differs from the storage position so that the second roll carrier can be equipped easily and safely and with a large safety distance from the first paper roll receptacle and a possibly rotating first paper roll. In particular, the second paper roll receptacle or the second roll carrier can pivot about an axis, where this pivot axis preferably runs orthogonally to the shaft or spindle axis.

According to yet another embodiment of the apparatus according to the invention, the second roll carrier is formed by one or more pins or a sleeve which is/are disposed radially outside the transfer position of the first roll carrier when the second paper roll receptacle and/or the second roll carrier are located in the storage position. In the case where one or more pins are present, these run in particular parallel to the shaft or spindle axis, and are preferably arranged uniformly around this axis. In the case where a sleeve is present which forms the second roll carrier, the sleeve wall (cylinder wall) extends parallel around the shaft or spindle axis.

The object is further achieved by a labelling machine with a labelling apparatus which comprises a feed device for supplying a material strip of labels or carrier strip with detachable labels as well as a transfer device for transferring the labels from the material or carrier strip to an object to be labelled, where the feed device comprises a device such as has been described previously. The labelling machine can be configured as explained initially. In particular, a material or carrier strip can be unwound from a paper roll as has been described previously and supplied via the feed device to a transfer device where in the latter the labels are detached from the material or carrier strip and transferred to the respective object. In particular, the labelling machine can also have a buffer with dancer rollers such as have also been described initially. With such a buffer, the time required for changing the paper rolls from the second paper roll receptacle into the first paper roll receptacle can easily be bridged.

The object is finally also achieved by a method for changing paper rolls, in particular using an apparatus such as has been described previously, in which the following steps are carried out:

- equipping a first roll carrier of a first paper roll receptacle with a first paper roll in an unwinding position, by placing the first paper roll on the first roll carrier,
- unwinding the first paper roll in the unwinding position of the first roll carrier,
- equipping a second roll carrier of a second paper roll receptacle with a second paper roll, in particular by placing the second paper roll on the second roll carrier, which is preferably accomplished in an equipping position (the equipping can take place whilst the first roll carrier is equipped with the first paper roll or whilst the first paper roll is unwound),
- after the first paper roll (this can also mean any paper roll core element that may be present on which the first paper roll was wound) has been removed from the first roll carrier or the first roll carrier is released from the first paper roll (or the paper roll core element), whereby in particular the paper roll is unwound or the paper roll is removed from the first roll carrier for another reason, moving the first roll carrier along an axis into the interior of the second roll carrier, that is into the interior of the intervention region of the second roll carrier, into a transfer position, during and/or after moving the first roll carrier into the interior of the second roll carrier, that s into the interior of the intervention region of the second roll carrier, radial displacement of at least one clamping device, for example, clamping jaw, of the first roll carrier into a clamping position and thereby clamping the second paper roll on the first roll carrier, and after clamping the second paper roll on the first roll carrier, moving the first roll carrier along the axis back into the unwinding position of the first roll carrier.

Since the originally second paper roll on the first roll carrier is now in the unwinding position, this can be unwound. This unwinding process then again corresponds to the second bullet point in the previous listing ("unwinding the first paper roll in the unwinding position of the first roll carrier") so that the method according to the invention can then be repeated in particular from this point.

The step of equipping the first roll carrier with the first paper roll can, in particular when this involves the equipping for the first time, be accomplished either by placing the first paper roll on the first roll carrier by hand whereby after placement, in particular a radial displacement of the at least one clamping device, in particular clamping jaw, of the first roll carrier into a clamping position (i.e. radially outwards) and thereby a firm clamping of the first paper roll on the first roll carrier is accomplished. In order to bring about the radial displacement, a separate axial stop can be provided which is preferably moved for this purpose temporarily between the winding position and the transfer position so that it is aligned with the shaft axis. The radial displacement can then be accomplished whereby the first roll carrier from the unwinding position arrives or is pressed against the separate stop which prevents the first roll carrier from being able to move in the axial direction further from the unwinding position than up to this point, where the shaft however can still nevertheless move in the direction of the unwinding position to the transfer position and thereby brings the clamping device(s) articulated to or moulded on the first roll carrier into the clamping position. The paper roll disposed on the first roll carrier is in this way clamped on the first roll carrier.

Alternatively the equipping of the first roll carrier with the first paper roll can also be accomplished whereby previously the second roll carrier is equipped with the first paper roll, in particular by placing the first paper roll on the second roll carrier, which is preferably accomplished in the equipping position where the first roll carrier is then moved along the axis into the interior (the intervention region) of the second roll carrier into the transfer position where, during and/or after the movement of the first roll carrier into the interior (of the intervention region) of the second roll carrier, the at least one clamping device, for example clamping jaw, of the first roll carrier is displaced into a clamping position and as a result the first paper roll is clamped on the first roll carrier, whereupon the first roll carrier with the first paper roll is moved along the axis back into the unwinding position of the first roll carrier, with the result that the first roll carrier is also equipped (for the first time).

It can also be provided, in particular after equipping the first roll carrier with the respective paper roll, that the outer end of the paper roll is threaded into a subsequent device, for example, unwinding device where the threading preferably takes place automatically but can also be performed by hand. Alternatively it is also feasible to stick together the outer end of the second paper roll which is located on the second paper roll carrier in the transfer position, with the inner end of the paper roll which is located on the first paper roll carrier in the unwinding position and which is or should be unwound. The sticking together is preferably also accomplished automatically but can also be performed by hand.

According to one embodiment of the method according to the invention, it is provided that before the first roll carrier is released from the first paper roll, the outer (outer-lying) end, that is the beginning, of the second paper roll is connected to the inner (inner-lying) end of the first paper roll, in particular adhesively bonded, whereby the material or carrier strip is in particular configured as an endless strip. The beginning of the second paper roll is in particular connected to the end of the first paper roll when the first roll carrier executes no rotary movement, the unwinding process is therefore stopped. In this case, the described buffer with the dancer rollers can bridge the time required to join the two paper roll ends together. In order to simplify the joining of the two ends, in particular each paper roll has an adhesive strip at the beginning, preferably on the side of the carrier strip facing away from the labels.

According to yet another embodiment of the method according to the invention, the first paper roll and/or the second paper roll has a separate core element as has already been described. The paper roll core element is usually a sleeve-like core element, preferably made of metal and/or board and/or wood and/or plastic. The core element (also called core) touches and surrounds the respective roll carrier equipped with the paper roll and is used to receive the wound carrier strip with the adhesive labels. After a paper roll has been completely unwound, only the core element remains which then, before renewed equipping of the first roll carrier with a second paper roll, must be removed or scraped from this, which is achieved in particular whereby the first roll carrier is moved from the unwinding position into the ejection position, as has been described previously. For the sake of completeness it should be pointed out that in principle, in the previously described paper roll changing apparatus, the previously described labelling machine and the corresponding method for changing paper rolls, paper rolls with and also paper rolls without a separate core element can be used. When using a paper roll without a separate core element, the movement of the first roll carrier from the unwinding position into an ejection position is then unnecessary since the first roll carrier is automatically free after the complete unwinding of the paper roll. Accordingly, in the latter case the paper roll changing apparatus also need not have the technical means with which the first roll carrier can be moved from the unwinding position into an ejection position.

According to another embodiment of the method according to the invention, it is provided that, as has already been explained previously by reference to the apparatus, for removal of the first paper roll and/or the core element of the first paper roll from the first roll carrier, the at least one clamping device or clamping jaw of the first roll carrier is radially displaced into a release position in which the first paper roll rests loosely on the first roll carrier, i.e. is no longer clamped.

Accordingly, according to another embodiment of the method according to the invention, it can be provided that for removal of the first paper roll and/or the core element of the first paper roll from the first roll carrier, the first roll carrier is moved along the axis past a scraper element into an ejection position, which is farther away from the transfer position (in the axial direction) than the unwinding position, wherein during the movement of the first roll carrier from the unwinding position into the ejection position, the first roll carrier passes the scraper element and the first paper roll and/or the core element of the first paper roll is gripped by the scraper element and scraped from the first roll carrier.

In the method according to the invention, according to yet another embodiment it can finally be provided that for equipping the second roll carrier with the second paper roll the second paper roll receptacle and/or the second roll carrier are moved from a storage position to an equipping position, in particular pivoted, wherein in the equipping position the second roll carrier is disposed outside the movement range of the first roll carrier.

Figure 2:
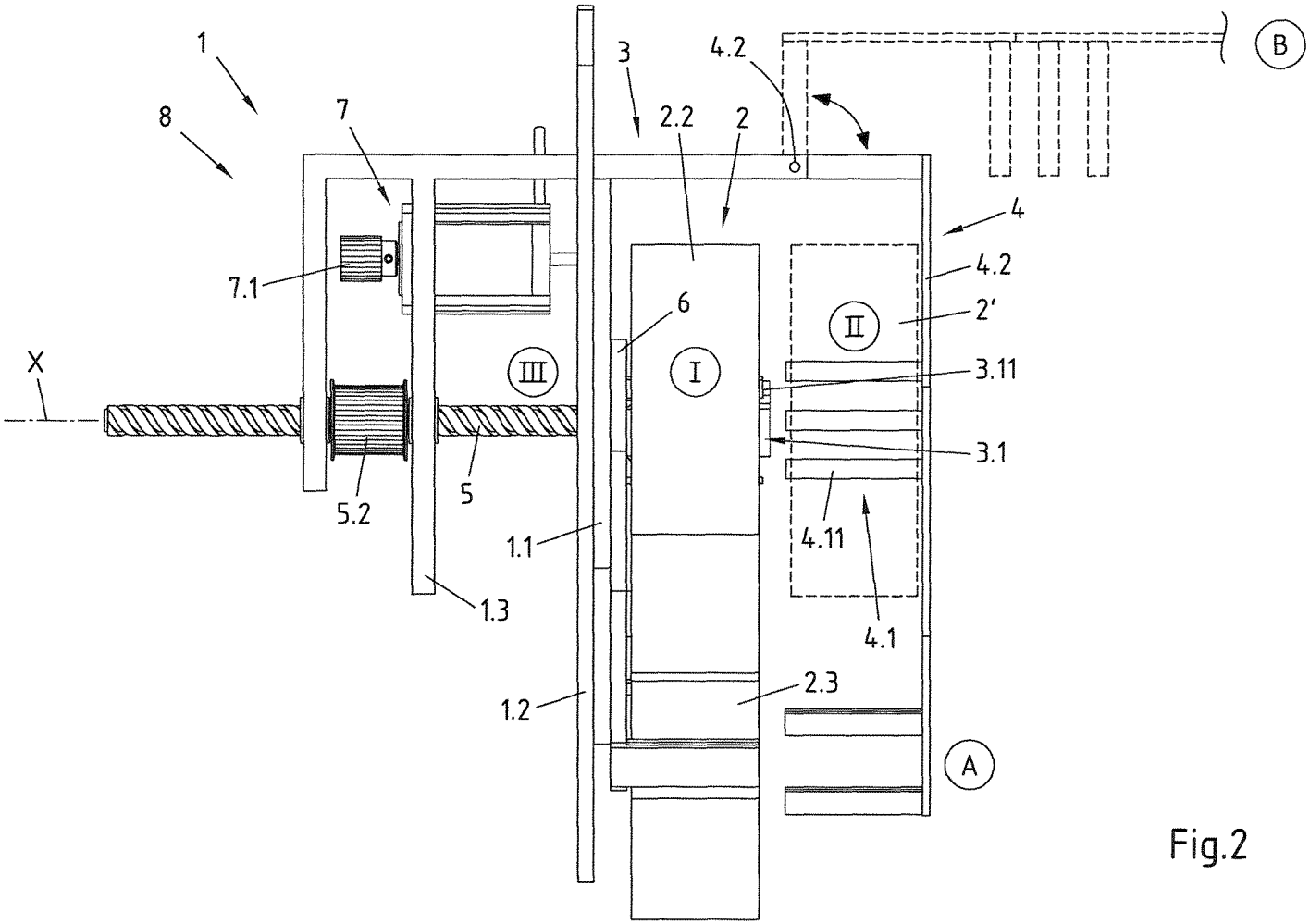
Figure 3:
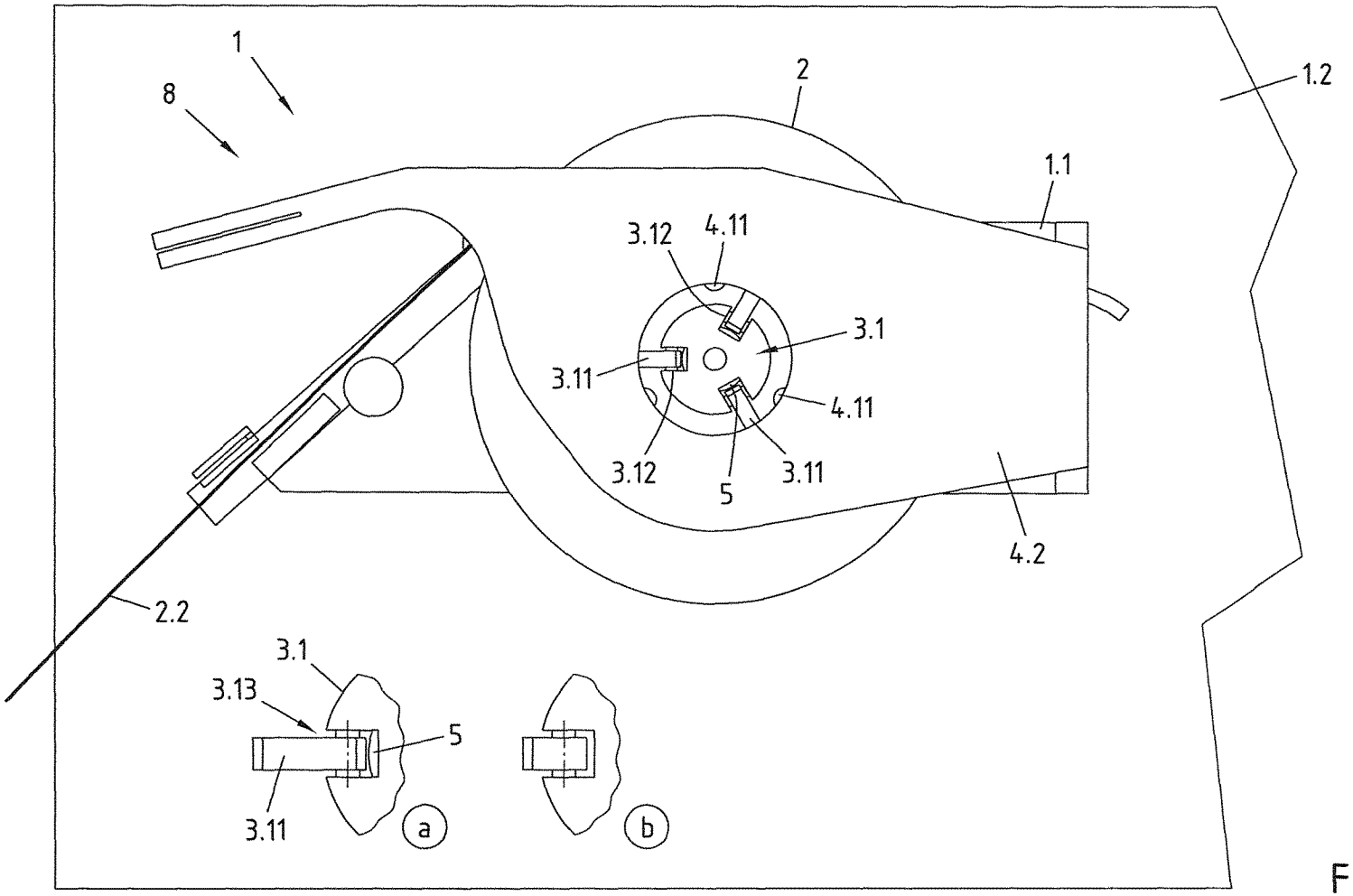
Figure 4:
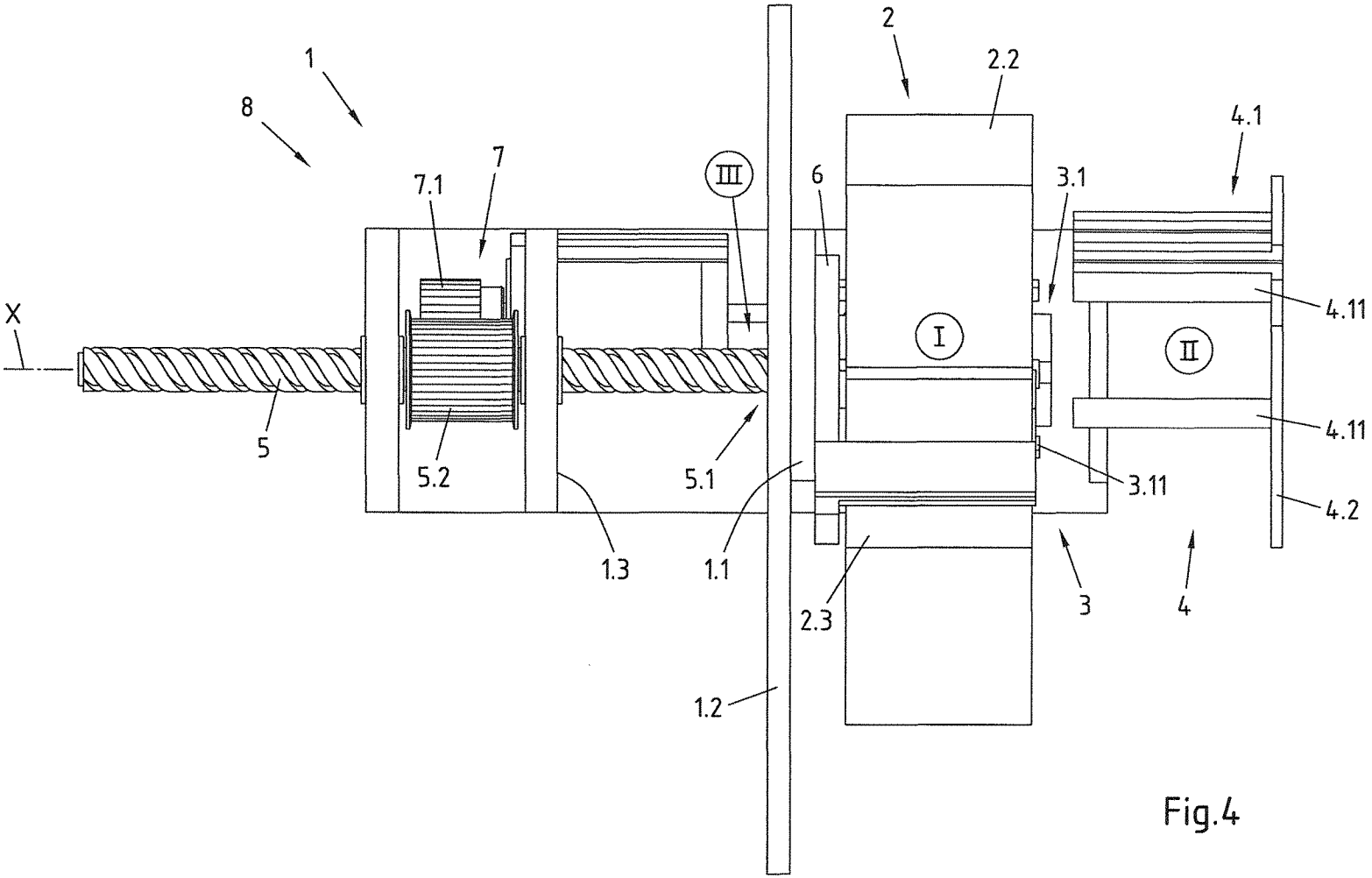

There are now numerous possibilities for configuring and further developing the apparatus according to the invention for changing paper rolls, the labelling machine according to the invention and the method according to the invention for changing paper rolls. In this respect, reference is made on the one hand to the claims following claim 1, on the other hand to the description of an exemplary embodiment in conjunction with the drawings. In the drawings:

FIG. 1 shows a perspective view of an apparatus for changing paper rolls according to the present invention, FIG. 2 shows a plan view of the apparatus from FIG. 1, FIG. 3 shows a side view of the apparatus from FIG. 1 and FIG. 4 shows a front view of the apparatus from FIG. 1.

The apparatus 1 shown in FIGS. 1 to 4 is part of a feed device 8 for feeding a carrier strip 2.2 with labels 2.3 which can be released from the carrier strip 2.2 and transferred (glued) onto the objects to be labelled. The apparatus 1 and feed device 8 is the subject of a labelling machine (not shown). The apparatus 1 according to the invention is used for changing paper rolls 2, 2' from a second paper roll receptacle 4 to a first paper roll receptacle 3. The paper rolls 2, 2' here for example comprise carrier strips 2.2 which in the present case are wound around a core element 2.1 made of board. Alternatively the carrier strip 2.2 can also be wound without a core element and form a paper roll 2 and 2', respectively. A paper roll can also mean a wound material strip of labels (linerless labels).

The first paper roll receptacle 3 is used to receive a first paper roll 2 which can be unwound in this receptacle 3. The second paper roll receptacle 4 is used to receive a second paper roll 2' which is intermediately stored in the receptacle 4 until this is transferred by the subsequently described procedure into the first paper roll receptacle 3.

The apparatus 1 further comprises a spindle-shaped shaft 5 which can be moved to and fro along an axis X, the first end of which (right end in the figure) is connected to a first roll carrier 3.1 (via a threaded connection). The roll carrier 3.1 is also movable to and fro along the axis X and specifically between an unwinding position I and a transfer position II. Furthermore, the first roll carrier 3.1 can also be brought into an ejection position III which is even further axially distant from the transfer position II than the unwinding position I.

The first roll carrier 3.1 is an originally rotationally symmetrical body into which three grooves 3.13 running parallel to the axis of rotation are inserted on the outside, which are uniformly spaced apart from one another in the circumferential direction. Lever-shaped clamping jaws 3.11 are pivotably mounted in these grooves 3.13. The clamping jaws 3.11 are articulated to the first roll carrier 3.1 via a pivot axis 3.12 which runs transversely to the grooves 3.13. The respectively front end (directed towards the second paper roll receptacle 4) of the clamping jaws 3.11 has a contact surface on the outside for inside contact with the core element 2.1 of a paper roll 2 and 2', respectively. The rearward end of the clamping jaws 3.11 is located on the other side of the suspension point (bearing) of the clamping jaw 3.11 and cooperates with the spindle 5 so that the spindle 5, when moved relative to the first roll carrier 3.1, either presses apart or releases the clamping jaws 3.11. The clamping jaws 3.11 are thus radially displaceable between a clamping position a and release position b, where the clamping position a lies further outside than the release position b.

Lever-shaped clamping jaws 3.11 which are pivoted were described previously as an example. It is however also feasible that the clamping jaws are elements which extend both in the clamping position a and also the release position b parallel to the axis X. The clamping jaws are then displaced in the radial direction between clamping and release position without changing their angle with respect to the axis X. Compared with pivotable clamping jaws, the latter clamping jaws have the advantage of a more extensive contact in the paper roll core or in the paper roll.

The second paper roll receptacle 4 further has a second roll carrier 4.1 which is formed by three pins 4.11 which run parallel to the axis X and in each case are so far removed from the axis X that the first roll carrier 3.1 can be moved into a position between the pins 4.11. This position is defined as transfer position II.

In FIGS. 1 to 4, the second paper roll receptacle 4 and the second roll carrier 4.1 are disposed in storage position A which is located coaxially with respect to the first roll carrier 3.1. In the transfer position II of the first roll carrier 3.1 which lies between the pins 4.11, the first roll carrier 3.1 together with the clamping jaws 3.11 is located at least in sections in the interior of the second roll carrier 4.11 disposed in storage position A and can here receive a second paper roll 2' mounted in the second paper roll receptacle 4 by spreading the clamping jaws 3.11. The first roll carrier 3.1 can then be moved into the unwinding position I in which the first roll carrier 3.1 together with the clamping jaws 3.11 is located outside (the intervention region) of the second roller carrier 4.1 located in storage position A. In this position I a paper roll 2, as shown in FIG. 1, can be unwound.

After the paper roll 2 has been unwound, the first roll carrier 3.1 can be moved along the axis X into the ejection position III, where the roll carrier 3.1 is thereby moved through one opening each in the walls 1.1 and 1.2 of the apparatus 1. The right wall 1.1 in the figures or the edge of the opening (not shown) provided in this wall 1.1 through which the first roll carrier 3.1 is moved from the unwinding position I into the ejection position III forms a scraper element 6 which passes the first roll carrier 3.1 when it is moved into the ejection position III. The scraper element serves to automatically scrape the core element 2.1 of the paper roll 2 after this is unwound.

When the first roll carrier 3.1 is in the transfer position II, the clamping jaws 3.11 are located in the radially outer position, that is the clamping position a. As a result, a second paper roll 2' as shown by the dashed line in FIG. 2, can be clamped on the first roll carrier 3.1. If the roll carrier 3.1 is moved back into the unwinding position I, the clamping position a is preserved in the present case, that is the paper roll remains clamped on the roll carrier 3.1 as before. Only when the paper roll is unwound and the roll carrier 3.1 is moved into the ejection position III, are the clamping jaws 3.11 moved into the release position b with the result that the core element 2.1 is released from the first roll carrier 3.1. In so doing, the clamping jaws 3.11 which are initially still in the clamping position a, during movement of the first roll carrier 3.1 from the unwinding position I into the ejection position III, also come into contact with the scraper element 6, that is the opening in the wall 1.1, and are thereby compressed so that they enter into the release position b.

The pressing apart of the clamping jaws 3.11 in the transfer position II is accomplished, for example, whereby the first roll carrier 3.1 in transfer position II is pressed against the wall 4.2 of the second receptacle 4, the wall 4.2 thus forms a stop for the roll carrier 3.1 which prevents the roll carrier 3.1 from being able to move further to the right. The spindle 5 is mounted by means of a thread in the first roll carrier 3.1 so that when the roll carrier 3.1 can no longer move further to the right in the axial direction, said spindle can nevertheless move relative to the roll carrier 3.1 where this relative movement has the result that the rear ends (facing the spindle 5) of the clamping jaws 3.11 are contacted by the spindle end where the force exerted by the spindle 5 on the lever-shaped clamping jaws 3.11 presses apart the clamping jaw levers 3.11 and specifically into said clamping position a. A correspondingly reversed effect is achieved when the first roll carrier 3.1 is moved into the ejection position III and there comes in contact with the wall 1.3 of the device 1. In this case, the wall 1.3 forms a stop for the first roll carrier 3.1 in the ejection position III so that the roll carrier 3.1 can no longer move further to the left in the axial direction. However, the spindle 5 can move further relative to the first roll carrier 3.1 with the result that the force which the spindle 5 has previously exerted on the clamping jaws 3.11 is cancelled so that the clamping jaws 3.11 can again enter into the release position b.

FIGS. 1, 2 and 4 show an electric drive 7 in part, which moves the spindle 5 both rotationally around the axis X (with a first motor) and also translationally along the axis X (with a second motor, not shown here). For reasons of clarity, no connection is shown between the toothed output-side shaft 7.1 of the drive 7 and the likewise toothed transmission element 5.2. The connection can consist of a toothed belt or a transmission. The externally toothed transmission element 5.2 is fixed axially on the housing of the apparatus 1, therefore cannot move along the axis X. Inside, the transmission element 5.2 has an internal thread which corresponds with the external thread of the spindle 5. The first roll carrier 3.1 has a correspondingly corresponding internal thread.

As shown in FIG. 2, the second paper roll receptacle 4 has a pivot axis 4.2 which allows the second paper roll receptacle 4 and the second roll carrier 4.1 to move, that is to pivot, between the storage position A and an equipping position B. In the equipping position B the second roll carrier 4.1 lies outside the movement range of the first roll carrier 3.1, that is the first roll carrier 3.1 would not enter between the pins 4.11 of the second roll carrier 4.1 when it is located in the transfer position II and the second paper roll receptacle 4 is disposed in the equipping position B.

A method for changing paper rolls 2, 2' is now described which can be performed by the apparatus 1. The method includes the following steps:

equipping a first roll carrier 3.1 of a first paper roll receptacle 3 with a first paper roll 2 in an unwinding position I, by placing the first paper roll 2 on the first roll carrier 3.1, unwinding the first paper roll 2 in the unwinding position I of the first roll carrier 3.1, equipping a second roll carrier 4.1 of a second paper roll receptacle 4 with a second paper roll 2', after the first paper roll 2 has been removed from the first roll carrier 3.1, moving the first roll carrier 3.1 along an axis X into the interior (of the intervention region) of the second roll carrier 4.1 into a transfer position 2, during and/or after moving the first roll carrier 3.1 into the interior (of the intervention region) of the second roll carrier 4.1, radial displacement of at least one clamping device 3.11 of the first roll carrier 3.1 into a clamping position a and thereby clamping the second paper roll 2' on the first roll carrier 3.1, and after clamping the second paper roll 2' on the first roll carrier 3.1 moving the first roll carrier 3.1 along the axis X back into the unwinding position I of the first roll carrier 3.1.

The invention claimed is:

1. An apparatus for changing paper rolls in a labelling machine, the apparatus comprising:

a first paper roll receptacle for a first paper roll;

a second paper roll receptacle for a second paper roll; and a shaft which can be moved to and fro along an axis;

wherein the first paper roll receptacle comprises a first roll carrier connected to a first end of the shaft, wherein the first roll carrier is movable to and fro along the axis between an unwinding position and a transfer position, wherein the first roll carrier has at least one clamping device which is radially displaceable between a clamping position and a release position, having a contact surface which in the clamping position lies radially further outwards than in the release position, wherein the second paper roll receptacle has a second roll carrier which in a storage position is disposed coaxially with respect to the first roll carrier, wherein in the unwinding position of the first roll carrier the first roll carrier together with the at least one clamping device is disposed at least in sections outside the second roll carrier disposed in the storage position, and wherein in the transfer position of the first roll carrier the first roll carrier together with the at least one clamping device is disposed at least in sections in an interior of the second roll carrier disposed in the storage position.

2. The apparatus according to claim 1, wherein the shaft is configured as a spindle.

3. The apparatus according to claim 1, wherein the first roll carrier comprises at least two clamping devices which are radially displaceable between a clamping position and a release position, each including a contact surface which in the clamping position lies radially further outwards than in the release position.

4. The apparatus according to claim 1, wherein the first roll carrier is movable along the axis into an ejection position which is farther away from the transfer position than the unwinding position.

5. The apparatus according to claim 4, further comprising a scraper element which passes the first roll carrier when the first roll carrier is moved along the axis from the unwinding position into the ejection position.

6. The apparatus according to claim 4, wherein the at least one clamping device is configured such that, alone or in cooperation with the shaft and the first roll carrier, the at least one clamping device is in the release position or can be brought into the release position when the first roll carrier is in the ejection position.

7. The apparatus according to claim 1, wherein the at least one clamping device is configured such that, alone or in cooperation with the shaft and the first roll carrier, the at least one clamping device is in the clamping position or can be brought into the clamping position when the first roll carrier is in the transfer position.

8. The apparatus according to claim 1, wherein the at least one clamping device is configured such that, alone or in cooperation with the shaft and the first roll carrier, the at least one clamping device is in the clamping position or in an intermediate position between the clamping position and the release position when the first roll carrier is in the unwinding position.

9. The apparatus according to claim 1, wherein the first roll carrier is connected to the shaft such that as a result of at least one of a rotational movement of the shaft about the axis and a translational movement of the shaft along the axis, radial displacement of the at least one clamping device between the clamping position and the release position is brought about.

10. The apparatus according to claim 1, further comprising a drive which moves the shaft translationally along the axis and moves the shaft rotationally about the axis, wherein the drive comprises a single motor or two separate motors.

11. The apparatus according to claim 1, wherein the second paper roll receptacle or the second roll carrier is movable between the storage position and an equipping position, and wherein in the equipping position the second roll carrier lies outside a movement range of the first roll carrier.

12. The apparatus according to claim 1, wherein the second roll carrier is formed by one or more pins or a sleeve disposed radially outside the transfer position of the first roll carrier when the second paper roll receptacle or the second roll carrier is located in the storage position.

13. A labelling machine provided with a labelling apparatus which includes a feed device for supplying a material strip of labels or carrier strip with detachable labels and a transfer device for transferring the labels from the material or carrier strip to an object to be labelled, wherein the feed device comprises an apparatus according to claim 1.

14. A method for changing paper rolls using an apparatus according to claim 1, the method comprising:

equipping a first roll carrier of a first paper roll receptacle with a first paper roll in an unwinding position, by placing the first paper roll on the first roll carrier;

unwinding the first paper roll in the unwinding position of the first roll carrier;

equipping a second roll carrier of a second paper roll receptacle with a second paper roll;

after the first paper roll has been removed from the first roll carrier, moving the first roll carrier together with at least one clamping device which is radially displaceable between a clamping position and a release position and has a contact surface which in the clamping position lies radially further outwards than in the release position, along an axis into the interior of the second roll carrier into a transfer position;

during or after moving the first roll carrier into the interior of the second roll carrier, radially displacing the at least one clamping device of the first roll carrier into the clamping position and thereby clamping the second paper roll on the first roll carrier; and after clamping the second paper roll on the first roll carrier, moving the first roll carrier along the axis back into the unwinding position of the first roll carrier.

15. The method according to claim 14, wherein at least one of the first paper roll and the second paper roll has a separate core element, which touches and surrounds the first roll carrier or the second roll carrier that is equipped with the paper roll.

16. The method according to claim 14, wherein for removal of the first paper roll or the core element of the first paper roll from the first roll carrier, the at least one clamping device of the first roll carrier is radially displaced into a release position in which the first paper roll rests loosely on the first roll carrier.

17. The method according to claim 14, wherein for removal of the first paper roll or the core element of the first paper roll from the first roll carrier, the first roll carrier is moved along the axis past a scraper element into an ejection position, which is farther away from the transfer position than the unwinding position, and wherein during the movement of the first roll carrier from the unwinding position into the ejection position, the first roll carrier passes the scraper element and the first paper roll or the core element of the first paper roll is gripped by the scraper element and scraped from the first roll carrier.

18. The method according to claim 14, wherein for equipping the second roll carrier with the second paper roll the second paper roll receptacle or the second roll carrier are moved from a storage position to an equipping position, and wherein in the equipping position the second roll carrier is disposed outside the movement range of the first roll carrier.

19. The method according to claim 14, wherein before the first roll carrier is released from the first paper roll, the outer end of the second paper roll is connected to the inner end of the first paper roll.

* * * * *